US011808026B2

(12) United States Patent
Zhao et al.

(10) Patent No.: US 11,808,026 B2
(45) Date of Patent: Nov. 7, 2023

(54) RESILIENT PRESTRESS-FREE STEEL STRUCTURE FORMED BY COMBINING PIN-ENDED COLUMNS WITH ELASTIC CENTERING BEAM

(71) Applicants: SOUTH CHINA UNIVERSITY OF TECHNOLOGY, Guangzhou (CN); BEIJING BRACE DAMPING ENGINEERING TECHNOLOGY CO., LTD, Beijing (CN)

(72) Inventors: Junxian Zhao, Guangzhou (CN); Guiqiang Hao, Beijing (CN); Yun Zhou, Beijing (CN); Xilong Chen, Guangzhou (CN); Wei Han, Beijing (CN); Xiaona Shi, Beijing (CN); Xuejing Chi, Beijing (CN)

(73) Assignees: SOUTH CHINA UNIVERSITY OF TECHNOLOGY, Guangzhou (CN); BEIJING BRACE DAMPING ENGINEERING TECHNOLOGY CO., LTD, Beijing (CN)

( * ) Notice: Subject to any disclaimer, the term of this patent is extended or adjusted under 35 U.S.C. 154(b) by 148 days.

(21) Appl. No.: 17/598,887

(22) PCT Filed: Aug. 20, 2020

(86) PCT No.: PCT/CN2020/110149
§ 371 (c)(1),
(2) Date: Sep. 28, 2021

(87) PCT Pub. No.: WO2021/032144
PCT Pub. Date: Feb. 25, 2021

(65) Prior Publication Data

US 2022/0154445 A1 May 19, 2022

(30) Foreign Application Priority Data

Aug. 20, 2019 (CN) ..... 201910770775

(51) Int. Cl.
*E04B 1/24* (2006.01)
*E04B 1/98* (2006.01)
*E04H 9/02* (2006.01)

(52) U.S. Cl.
CPC ..... *E04B 1/2403* (2013.01); *E04B 1/98* (2013.01); *E04H 9/02* (2013.01); *E04B 2001/2406* (2013.01); *E04B 2001/2439* (2013.01)

(58) Field of Classification Search
CPC .. E04B 1/2403; E04B 1/98; E04B 2001/2406; E04B 2001/2439;
(Continued)

(56) References Cited

U.S. PATENT DOCUMENTS 5,660,017 A * 8/1997 Houghton ..... E04H 9/024 52/283
9,580,924 B1 * 2/2017 Taylor ..... E04H 9/028
(Continued)

FOREIGN PATENT DOCUMENTS

CN 108755954 A * 11/2018 ..... E04B 1/2403
CN 109057014 12/2018
(Continued)

OTHER PUBLICATIONS

English translation of the International Search Report and Written Opinion for PCT/CN2020/110149 (8 pages). (Year: 2020).*
(Continued)

*Primary Examiner* — Rodney Mintz
(74) *Attorney, Agent, or Firm* — JCIPRNET

(57) ABSTRACT

A resilient prestress-free steel structure includes the elastic centering beam and two pin-ended box column bases. The elastic centering beam includes two cantilever segment I-shaped steel beams, a middle segment I-shaped steel beam and buckling restrained high strength steel bars. The canti-
(Continued)

lever segment I-shaped steel beams are fixed to the two pin-ended box column bases, the middle segment I-shaped steel beam is connected between the two cantilever segment I-shaped steel beams, the buckling restrained high strength steel bars are symmetrically arranged. One end of each of the buckling restrained high strength steel bars is firmly connected with the web of each of the cantilever segment I-shaped steel beams, and the other end of each of the buckling restrained high strength steel bars is firmly connected with the web of the middle segment I-shaped steel beam. The resilient prestress-free steel structure is arranged in left and right symmetrical manner.

7 Claims, 13 Drawing Sheets

(58) Field of Classification Search
CPC ..... E04B 2001/2415; E04B 2001/2442; E04B 2001/2463; E04H 9/02; E04H 9/024
See application file for complete search history.

(56) References Cited

U.S. PATENT DOCUMENTS

| | | | | |
|---|---|---|---|---|
| 10,036,176 | B1 * | 7/2018 | Taylor | E04H 9/028 |
| 10,781,582 | B2 * | 9/2020 | Tazarv | E04H 9/02 |
| 10,954,685 | B1 * | 3/2021 | Guo | E04H 9/0237 |
| 11,162,260 | B2 * | 11/2021 | Pryor | E04B 1/98 |
| 11,299,903 | B2 * | 4/2022 | Chi | E04B 1/98 |
| 11,598,086 | B2 * | 3/2023 | Onishi | E04B 1/5812 |
| 2016/0138263 | A1 * | 5/2016 | Koyama | F16F 15/02 52/167.1 |
| 2019/0078315 | A1 * | 3/2019 | Tazarv | E04H 9/02 |
| 2020/0109556 | A1 * | 4/2020 | Pryor | E04C 3/06 |
| 2020/0318342 | A1 * | 10/2020 | Onishi | E04B 1/5812 |
| 2021/0087843 | A1 * | 3/2021 | Guo | E04H 9/0237 |
| 2022/0049519 | A1 * | 2/2022 | Chi | E04H 9/0237 |

FOREIGN PATENT DOCUMENTS

| | | |
|---|---|---|
| CN | 109113189 | 1/2019 |
| CN | 109629762 | 4/2019 |
| CN | 208701908 | 4/2019 |
| CN | 109853733 | 6/2019 |
| CN | 110080463 | 8/2019 |
| CN | 110439112 | 11/2019 |
| JP | 2002004418 | 1/2002 |
| KR | 20180072947 | 7/2018 |

OTHER PUBLICATIONS

"International Search Report (Form PCT/ISA/210) of PCT/CN2020/110149," dated Oct. 22, 2020, with English translation thereof, pp. 1-6.

* cited by examiner

RESILIENT PRESTRESS-FREE STEEL STRUCTURE FORMED BY COMBINING PIN-ENDED COLUMNS WITH ELASTIC CENTERING BEAM

CROSS-REFERENCE TO RELATED APPLICATION

This application is a 371 of international application of PCT application serial no. PCT/CN2020/110149, filed on Aug. 20, 2020 which claims the priority benefit of China application no. 201910770775.X, filed on Aug. 20, 2019. The entirety of each of the above mentioned patent applications is hereby incorporated by reference herein and made a part of this specification.

BACKGROUND

Technical Field

The present invention relates to the anti-seismic field of building structures, in particular to a resilient prestress-free steel structure formed by combining pin-ended columns with elastic centering beam.

Description of Related Art

China is one of the earthquake-prone countries with the most severe earthquake disasters. Previous earthquake damage shows that a steel frame structure will generate severe plastic damage at beam-to-column joints and column base joints in an earthquake, which contributes to post-earthquake severe residual deformation of the integral structure, such that it is hard to repair the structure. The original structure has to be pushed down to be reconstructed, such that the time and cost needed by reconstruction are increased remarkably. Therefore, an idea of a current seismic design of the building structure is transformed from previous anti-collapse design into recoverable design. A self-centering structure is a novel structural system capable of achieving quick post-earthquake recovery of the structure. The technical concept lies in that an extra prestress unit (a prestress wire and the like) is arranged in the beam-to-column joint to apply prepressing action (as shown in the FIG. 1 and FIG. 2) to the beam. Under smaller earthquake action, a contact surface of a prepressed component keeps relatively large connecting rigidity by means of the prepressing action to resist the earthquake action. Under a larger earthquake, when an internal force generated on the contact surface exceeds the prepres sing action, the prepressed component can be decompressed to release the rigidity of the connecting surface and reduce the earthquake action and the internal force of a main structure, such that the main structure is prevented from suffering plastic damage. Earthquake energy is dissipated by an energy dissipating unit and residual deformation of the structure is overcome by the prestress unit to achieve self-centering structure after the earthquake. It can be known from the characteristics of the self-centering structure that the post-earthquake recovery of structure is still dependent on a prestress technology substantially, which will cause the following problems specifically.

(1) Complex construction: it is needed to apply prestress to the beam and column component at the construction site by the conventional self-centering structure, such that the field construction difficulty is increased and the construction period is prolonged, which cannot reflect the construction advantage of quick assembly of the steel structure fully.

(2) Poor anti-shear performance: the shear capacity of the beam-to-column component is fully dependent on a friction force at a rotating center after decompression between the beam and column components, the anti-shear force is low in reliability, and it is easy to produce a safety risk of slippage of the steel beam due to disable shear resistance in case of loss of prestress.

(3) Inharmonious with deformation of a floor slab: when the beam and column component is decompressed, as the rotating center is changed at the upper and lower flanges of the beam continuously, the floor slab is cracked severely (as shown in the FIG. 2) under an action of hogging moment (the upper flange of the beam is stretched), which is hard to repair the floor slab after the earthquake. The effect of restraint of the floor slab will further reduce the energy dissipating capacity of the energy dissipating unit arranged at the upper flange of the beam.

(4) Reduction of seismic energy dissipation capacity: the key technical requirement of the conventional self-centering structure lies in that the self-centering bending moment formed by the prestress of the prestress unit needs to be greater than a reverse bending moment generated by the internal force of the energy dissipating unit, such that the energy dissipating capacity of the joint will be reduced remarkably, which leads to reduction of seismic effect of the joint.

(5) Large acceleration response: collision and impact of repeated decompression of the beam and column component of the conventional self-centering joint will cause abrupt change in rigidity of the beam-to-column joint to lead to increase of earthquake acceleration response increase of the structure, thereby aggravating damage of non-structural components.

(6) Weak self-centering ability of the integral structure: at present, existing self-centering technologies primarily stay at self-centering in the level of the beam-to-column joint, and it is shown by actual earthquake damage that the column base of the steel frame will generate severe plastic damage in the earthquake as well and induce remarkable residual deformation, and therefore, it is needed to put forward an effective self-centering technology of the structure from the level of the integral structure.

SUMMARY

An object of the present invention is to provide a resilient prestress-free steel structure formed by combining pin-ended columns with an elastic centering beam, which solves the serial technical problems caused by adoption of prestress by the conventional self-centering steel structure substantially, thereby achieving post-earthquake self-centering from the level of the integral structure.

The objective of the present invention is at least realized by one of the technical solutions as follows.

A resilient prestress-free steel structure formed by combining pin-ended column with an elastic centering beam includes an elastic centering beam and two box columns with pin-ended base. The elastic centering beam includes two cantilever segment I-shaped steel beams, a middle segment I-shaped steel beam and buckling restrained high strength steel bars. The cantilever segment I-shaped steel beams are fixed to the two columns, the middle segment I-shaped steel beam is connected between the two cantilever segment I-shaped steel beams. The buckling restrained high strength steel bars are symmetrically arranged on two sides of a web along a beam central axis, and one end of each of the buckling restrained high strength steel bars is firmly connected with the web of each of the cantilever segment I-shaped steel beams and the other end of each of the buckling restrained high strength steel bars is firmly connected with the web of the middle segment I-shaped steel beam. The resilient prestress-free steel structures are arranged left and right symmetrically, i.e., it has the same structure on the left side and the right side.

Further, each of the buckling restrained high strength steel bars includes a high strength screw, a fixed cylindrical nut, two restraining steel tubes and a middle segment restraining short steel tube. The fixed cylindrical nut is fixed to a midpoint position of the high strength screw through a thread, the restraining steel tubes are symmetrically arranged on two sides of the fixed cylindrical nut and are firmly connected with the fixed cylindrical nut via butt welds, and inner diameters of the two restraining steel tubes are greater than a diameter of the high strength screw, such that it is ensured that a gap is reserved between the high strength screw and each of the two restraining steel tubes. The middle segment restraining short steel tube penetrates through the fixed cylindrical nut, two ends of the middle segment restraining short steel tube are firmly connected with the two restraining steel tubes via fillet welds respectively, and a midpoint position of the middle segment restraining short steel tube is aligned with the midpoint position of the high strength screw.

Further, two ends of the high strength screw are fixedly connected with the connecting steel plate through high strength nuts on two sides, i.e., two ends of each of the buckling restrained high strength steel bars are firmly connected with a connecting steel plate through high strength nuts on two sides, the connecting steel plate is firmly connected with two force transfer steel plates via butt welds. Upper and lower edges of the connecting steel plate are aligned with an upper edge of one force transfer steel plate and a lower edge of the other force transfer steel plate one by one, the force transfer steel plate on a side of each of the cantilever segment I-shaped steel beams is firmly connected with the web of each of the cantilever segment I-shaped steel beams, and the force transfer steel plate on a side of the middle segment I-shaped steel beam is firmly connected with the web of the middle segment I-shaped steel beam via fillet welds on two sides.

Further, the resilient prestress-free steel structure formed by combining pin-ended columns with an elastic centering beam further includes a buckling restrained energy dissipation plate. One end of the buckling restrained energy dissipation plate is fixed to a lower portion of a lower flange of each of the cantilever segment I-shaped steel beams and the other end of the buckling restrained energy dissipation plate is fixed to a lower portion of the lower flange of the middle segment I-shaped steel beam. The buckling restrained energy dissipation plate is composed of a linear-shaped core plate, a first restraining steel plate, a second restraining steel plate and two limiting steel plates. The linear-shaped core plate is dog bone-shaped, grooves matched with the limiting steel plates in shape are processed in two side surfaces in a length direction of the linear-shaped core plate respectively, slotted holes are formed in connecting segments at two ends of the length direction of the linear-shaped core plate, the limiting steel plates are positioned between the first restraining steel plate and the second restraining steel plate, the limiting steel plates are positioned on two sides of the linear-shaped core plate, the limiting steel plates are matched with the linear-shaped core plate in structure, the limiting steel plates are provided with several bolt holes, and positions of the first restraining steel plate and the second restraining steel plate corresponding to the limiting steel plates are provided with bolt holes. The linear-shaped core plate is fixed via a bolt, the first restraining steel plate is firmly connected with the two limiting steel plates via fillet welds. Unbounded materials are bonded to a left side surface, a right side surface, an upper side surface and a lower side surface of the linear-shaped core plate, the linear-shaped core plate and the two limiting steel plates are different in thickness, such that it is ensured that gaps are reserved between an upper surface and a lower surface of the linear-shaped core plate and the first restraining steel plate and the second restraining steel plate respectively. Gaps are reserved between the limiting steel plates and a yield segment of the linear-shaped core plate, such that it is ensured that gaps are reserved between the left side surface and the right side surface of the linear-shaped core plate and the limiting steel plates. Expanded segments at two ends of the linear-shaped core plate stretch into the restraining steel plate, and the extended length is not smaller than the width of the expanded segments at two ends of the linear-shaped core plate, thereby preventing deformation out of a surface when the linear-shaped core plate is subjected to a force out of the surface.

Further, the buckling restrained energy dissipation plate further includes two lower friction base plates. The lower friction base plates are firmly connected with two ends of the linear-shaped core plate via fillet welds and butt welds, upper surfaces of the lower friction base plates are subjected to sand blasting treatment, a friction coefficient of the lower friction base plates is not lower than 0.45, and slotted screw holes in the two lower friction base plates correspond to slotted screw holes in two ends of the linear-shaped core plate one by one. The lower portions of the lower flanges of each of the buckling restrained high strength steel bars and the middle segment I-shaped steel beam are connected and fixed to an upper friction base plate via weld joints, round screw holes of the lower flanges of each of the buckling restrained high strength steel bars and the middle segment I-shaped steel beam correspond to round screw holes of the upper friction base plate one by one, the lower surface of the upper friction base plate is subjected to sand blasting treatment, and a friction coefficient of the upper friction base plate is not lower than 0.45. The upper friction base plate and the lower friction base plates are made in contact, and the linear-shaped core plate, the lower friction base plates, the upper friction base plate and the lower flange of each of the buckling restrained high strength steel bars or the middle segment I-shaped steel beam are arranged in sequence from bottom to top and are connected via bolts.

Further, the resilient prestress-free steel structure formed by combining pin-ended columns with an elastic centering beam further includes a suspended connector. One end of the suspended connector is fixed to an upper flange of each of the buckling restrained high strength steel bars and the other end of the suspended connector is fixed to an upper flange of the middle segment I-shaped steel beam. The suspended connector includes two vertical anti-shearing plates, first splicing angle iron, second splicing angle iron, a first splicing steel plate and a second splicing steel plate. The first splicing angle iron, the second splicing angle iron, the first splicing steel plate and the second splicing steel plate are equal in length, and the length is equal to two times of a length of the vertical anti-shearing plates with an addition of a gap between the middle segment I-shaped steel beam and each of the cantilever segment I-shaped steel beams along an axis direction. One of the vertical anti-shearing plates is firmly connected with the upper surface of the upper flange of each of the cantilever segment I-shaped steel beams via the butt weld and the other vertical anti-shearing plates is firmly connected with the upper surface of the upper flange of the middle segment I-shaped steel beam via the butt weld, a shorter side plate of the first splicing angle iron and a shorter side plate of the second splicing angle iron are firmly connected with the vertical anti-shearing plate via high strength bolts, and the shorter side plate of the first splicing angle iron and the shorter side plate of the second splicing steel plate are symmetrically arranged on two sides of the vertical anti-shearing plate. The first splicing steel plates are firmly connected with the upper flange of each of the cantilever segment I-shaped steel beams and the upper flange of the middle segment I-shaped steel beam as well as a longer side plate of the first splicing angle iron via high strength bolts respectively, and the upper flange of the I-shaped steel beam is located between the first splicing steel plate and the longer side plate of the first splicing angle iron. The second splicing angle iron is firmly connected with the upper flange of each of the cantilever segment I-shaped steel beams and the upper flange of the middle segment I-shaped steel beam as well as a longer side plate of the second splicing angle iron respectively, and the upper flange of the I-shaped steel beam is located between the second splicing steel plate and the longer side plate of the second splicing steel plate.

Further, each of the two pin-ended box column includes a box type column, a base plate, an anchor bolt and a bottom plate. The box type column is firmly connected with the bottom plate via a fillet weld, and the anchor bolt penetrates through the base plate to firmly connect a periphery of the bottom plate with foundation soil. The box type column is connected with each of the cantilever segment I-shaped steel beams via a weld joint.

Further, the high strength bolt is manufactured by a 14.9-level high strength bolt.

A working principle of the present invention is as follows. Under a vertical load action, the suspended connector mainly bears a vertical shearing force at a beam-end. Under a small earthquake action, both the buckling restrained energy dissipating plate and the buckling restrained high strength steel bar are kept elastic and jointly bear a bending moment of the beam-end generated under the action of a horizontal earthquake. The suspended connector mainly bears an additional beam-end shearing force generated by the action of the horizontal earthquake. The buckling restrained energy dissipating plate yields to dissipate energy first (long arm of force and low yield strength) under medium and large earthquakes, the relative rotating rigidity of the beam-to-column joint is reduced, and the buckling restrained high strength steel bar (short arm of force and large elastic deformability) and the main structure are kept in an elastic state while the earthquake action of the structure is reduced. Post-yield second rigidity of the joint is increased while the buckling restrained high strength steel bar is arranged, which avoids a phenomenon of centralized transformation of a certain floor and reduces the post-earthquake residual deformation of the main frame. After the earthquake, by matching with a design of slotting two ends of the buckling restrained energy dissipating plate, a bolt pretightening force between the buckling restrained energy dissipating plate and the beam can be released after the earthquake. Internal force restraint to the cantilever segment I-shaped steel beam and the middle segment I-shaped steel beam is released by the energy dissipating plate via a chute. The joint is self-centered by means of the elastic restoring force of the buckling restrained high strength steel bar. Matched with the characteristics that the bending rigidity of the bottom plate in the pin-ended box column base is weak and rotating deformation of the box type column cannot be restrained (as shown in the FIG. 9), integral prestress-free self-centering of the structure is achieved.

The present invention has the following beneficial effects.

(1) The steel tube is adopted to restrain the high strength screw to achieve the centering unit which behaves elastically in tension and compression and is not buckled. By matching with the buckling restrained energy dissipating plate slotted in two ends, a bolt pretightening force between the buckling restrained energy dissipating plate and the beam can be released after the earthquake. Internal force restraint to the cantilever segment I-shaped steel beam and the middle segment I-shaped steel beam is released by the energy dissipating plate via a chute. The joint is self-centered by means of the elastic restoring force of the buckling restrained high strength steel bar. The self-centering effect of the beam-to-column joint under a prestress-free condition is achieved.

(2) Matched use of the pin-ended column and the elastic centering beam is provided, so that severe plastic damage of the column base under a strong earthquake is avoided. Rigidity of the column base by the bottom plate is released by means of a characteristic that the bending rigidity of the bottom plate of the column base is weak. Integral self-centering of the joint and the column under the prestress-free condition is achieved by means of elastic restoring bending moment of the elastic centering beam unit.

(3) A structure of stretching the extended segments at two ends of the buckling restrained energy dissipating plate into the restraining steel plate is put forward to play role of restraining torsional deformation outside a plane of the cantilever segment I-shaped steel beam and the middle segment I-shaped steel beam effectively, thereby ensuring the integrity of the cantilever segment I-shaped steel beam and the middle segment I-shaped steel beam in the direction outside the plane under a bidirectional earthquake effectively and preventing the loss of energy dissipation and self-centering property due to torsional deformation of the beam segment.

(4) A prestress process at a construction site is removed, the construction efficiency of the integral structure is improved obviously, the problem of loss of prestress is solved and the reliability of structural resetting is improved.

(5) A shear capacity is provided by splicing angle iron on the top of the upper flange of the beam, such that a problem that a conventional self-centering joint is ineffective in shear resistance as vertical shear force transfer dependent on friction force is solved.

DESCRIPTION OF THE EMBODIMENTS

Figure 1:
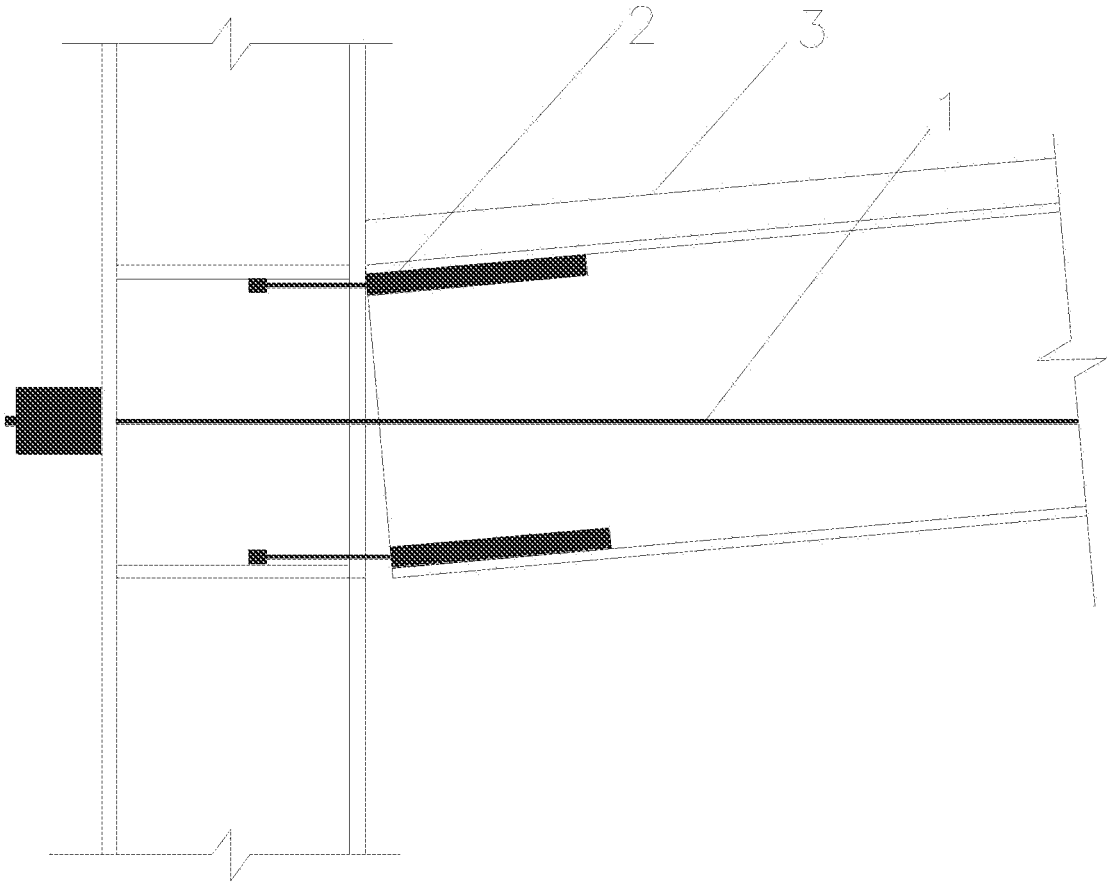
FIG. 1 is a sagging moment deformation diagram of an existing prestress self-centering beam-to-column joint.
Figure 2:
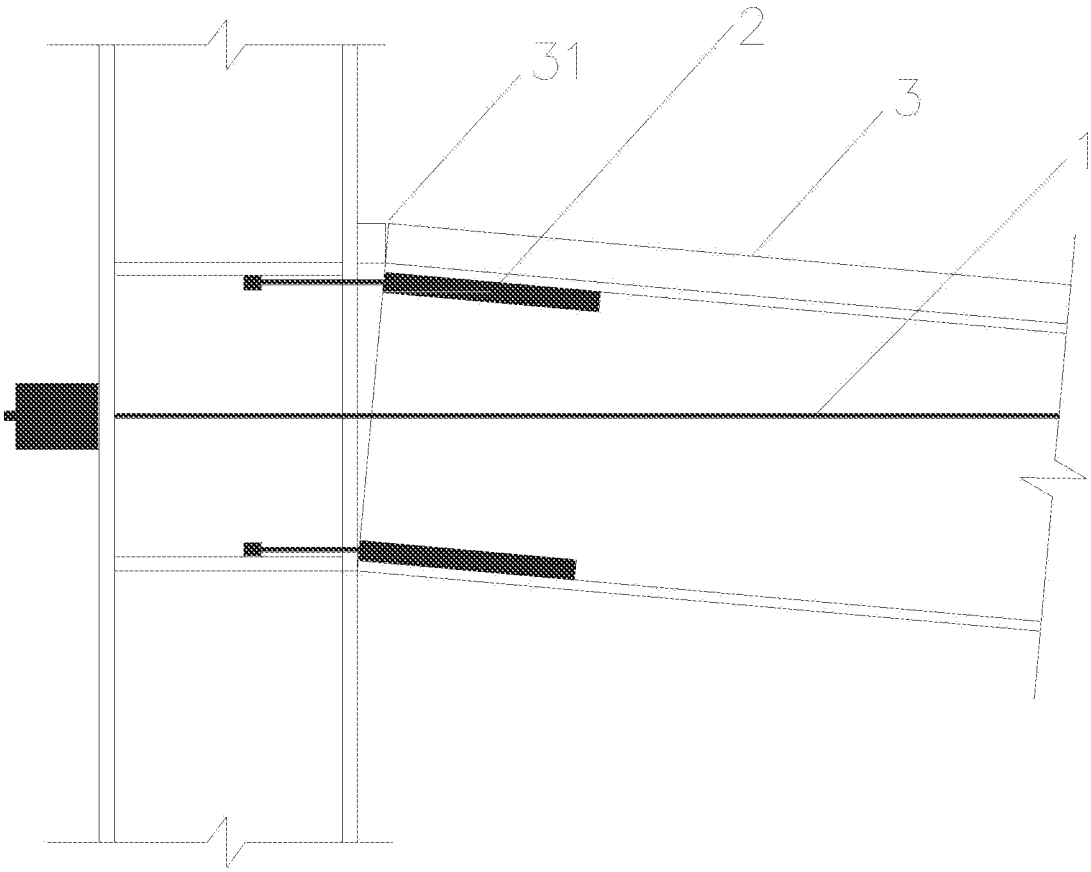
FIG. 2 is a hogging moment deformation diagram of an existing prestress self-centering beam-to-column joint.
Figure 3A:
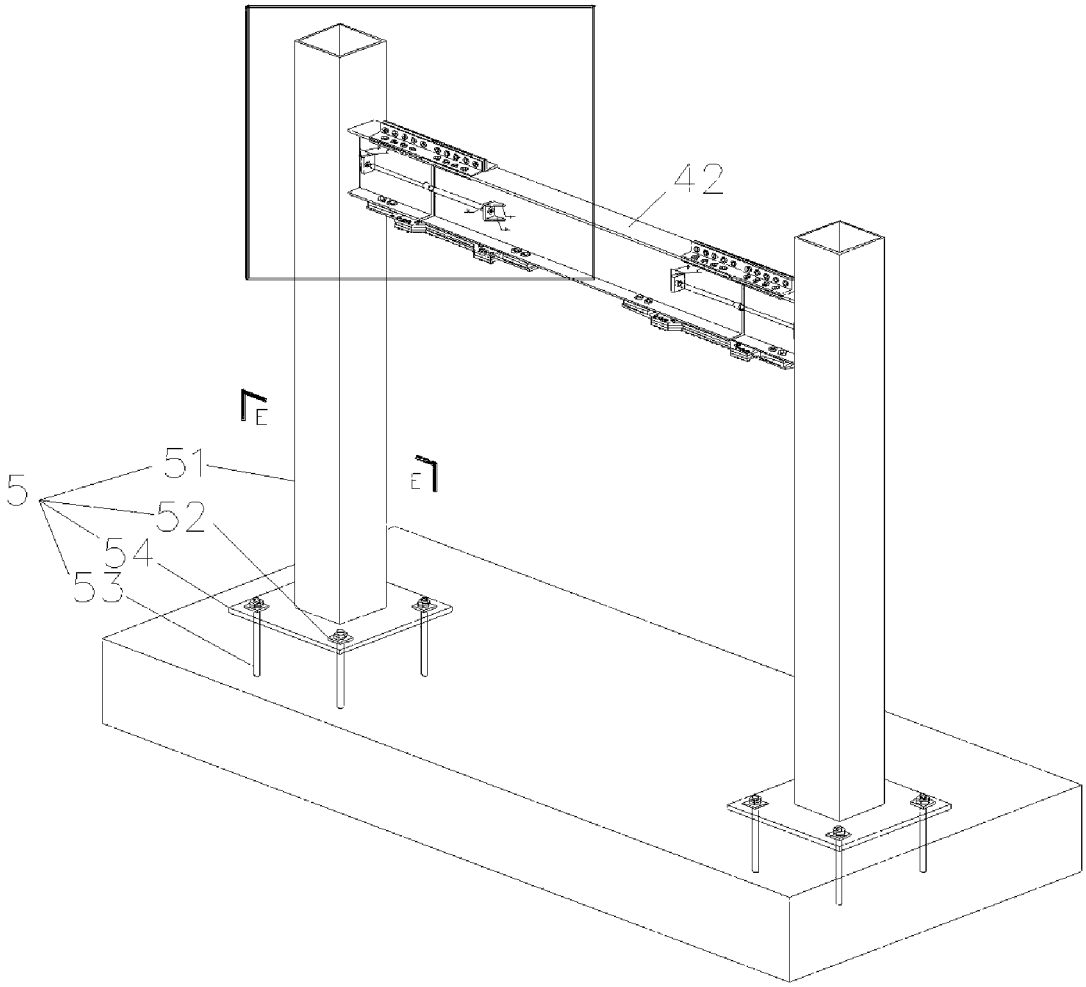
FIG. 3*a* is an integral structural three-dimensional schematic diagram of the present invention.
Figure 3B:
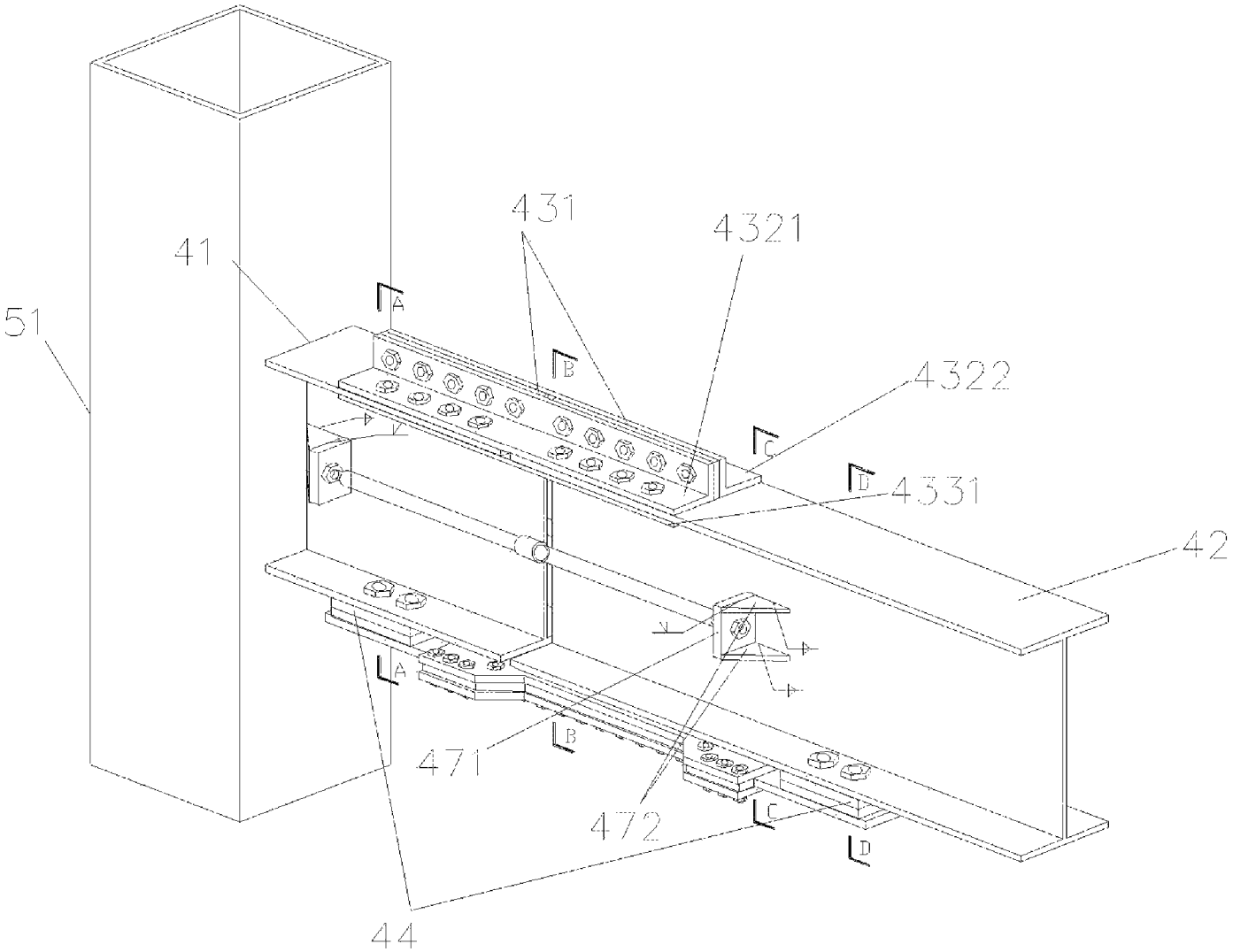
FIG. 3*b* is an integral structural partial enlarged drawing of the present invention.
Figure 4:
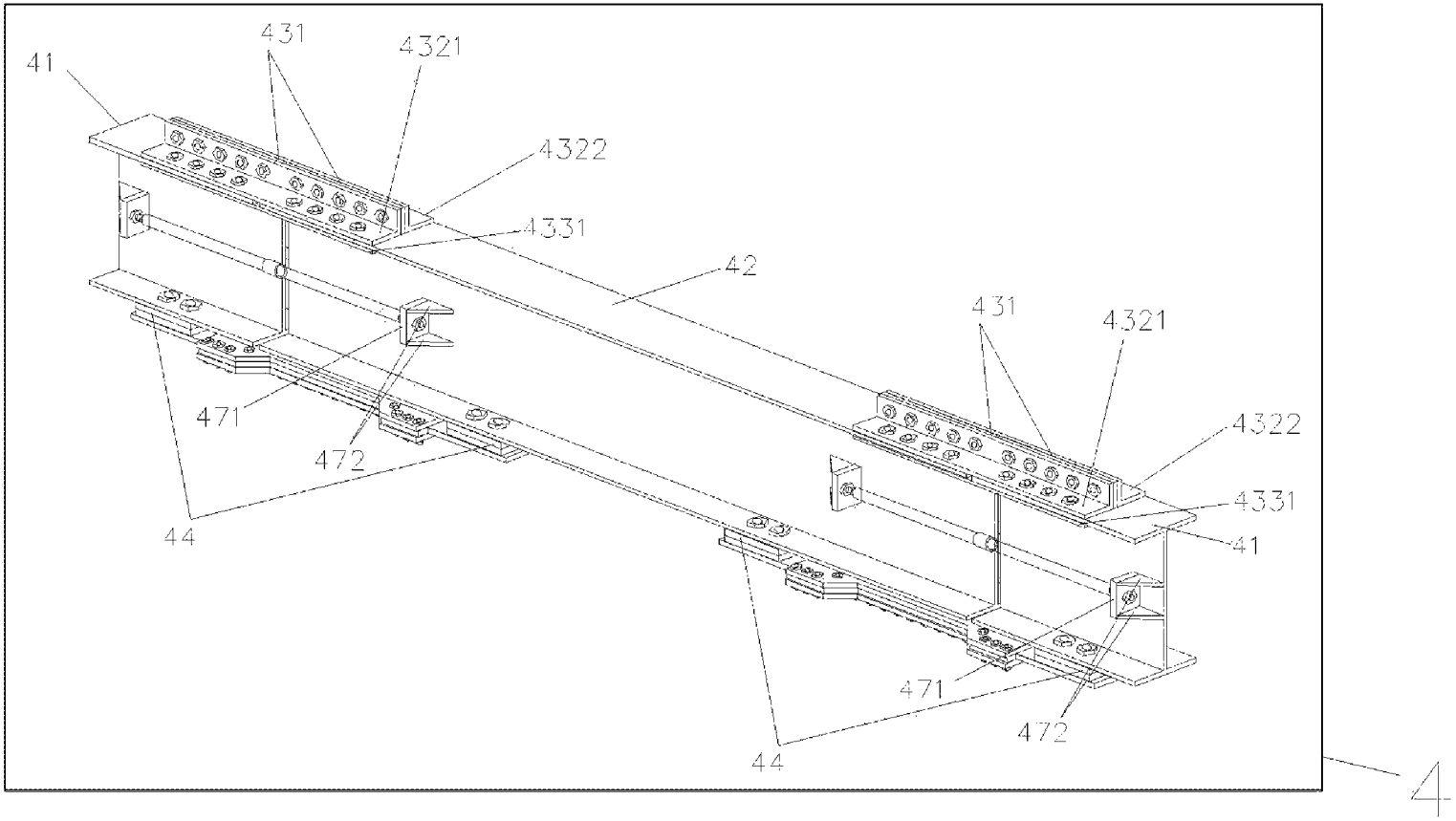
FIG. 4 is a three-dimensional schematic diagram of the elastic centering beam of the present invention.
Figure 5:
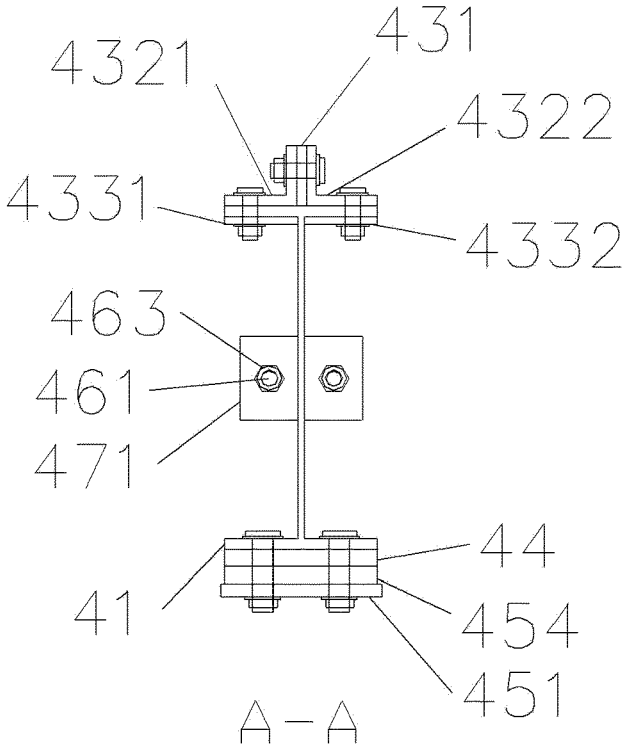
FIG. 5 is an A-A section view of FIG. 3*b;*
Figure 6:
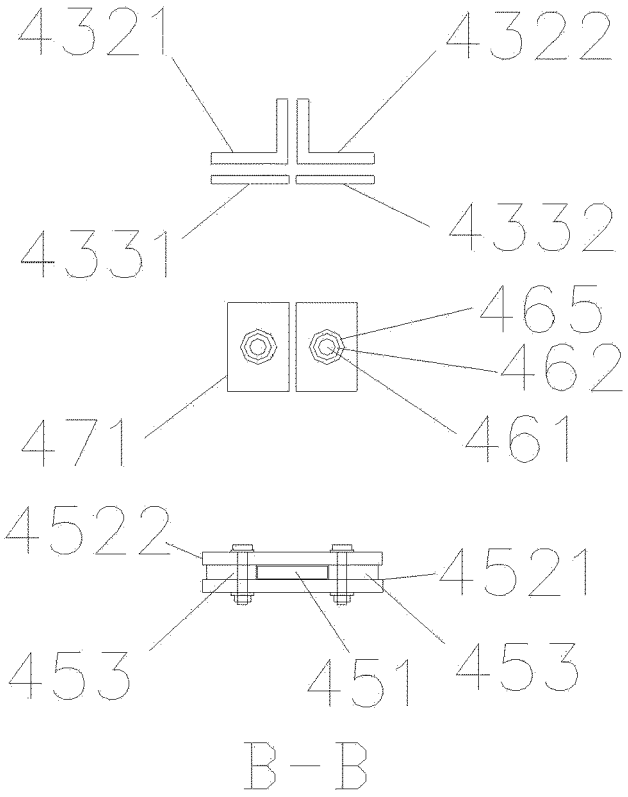
FIG. 6 is a B-B section view of FIG. 3*b;*
Figure 7:
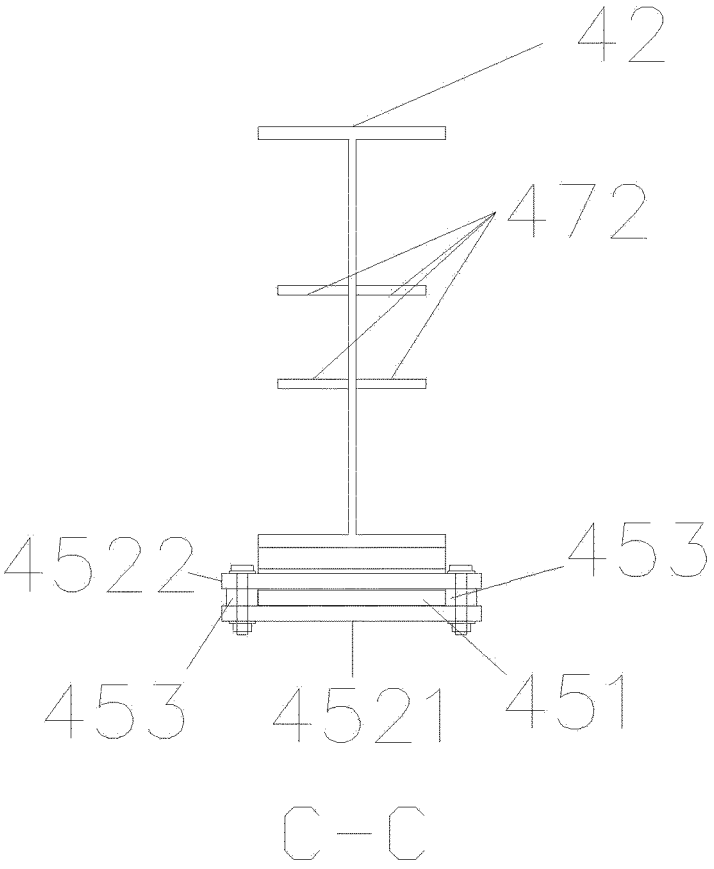
FIG. 7 is a C-C section view of FIG. 3*b;*
Figure 8:
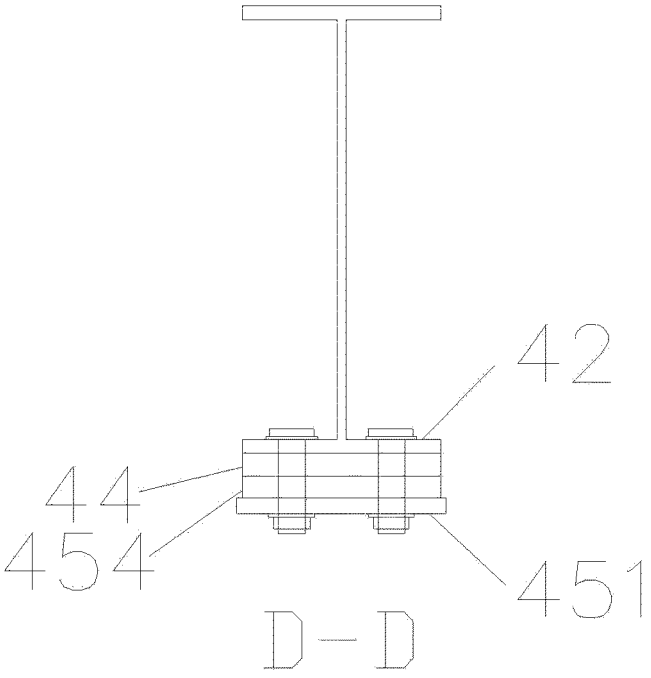
FIG. 8 is a D-D section view of FIG. 3*b;*
Figure 9:
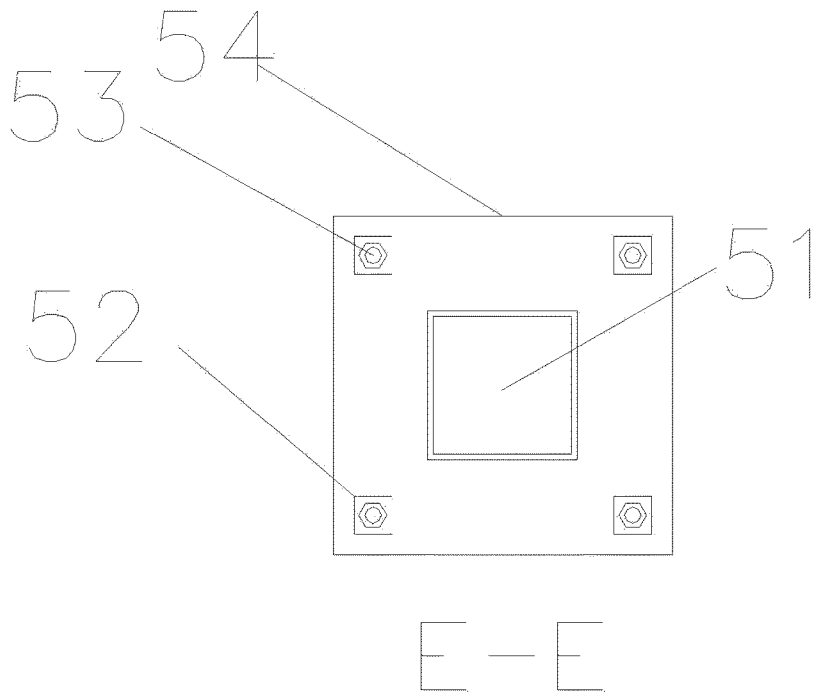
FIG. 9 is an E-E section view of FIG. 3*a;*
Figure 10:
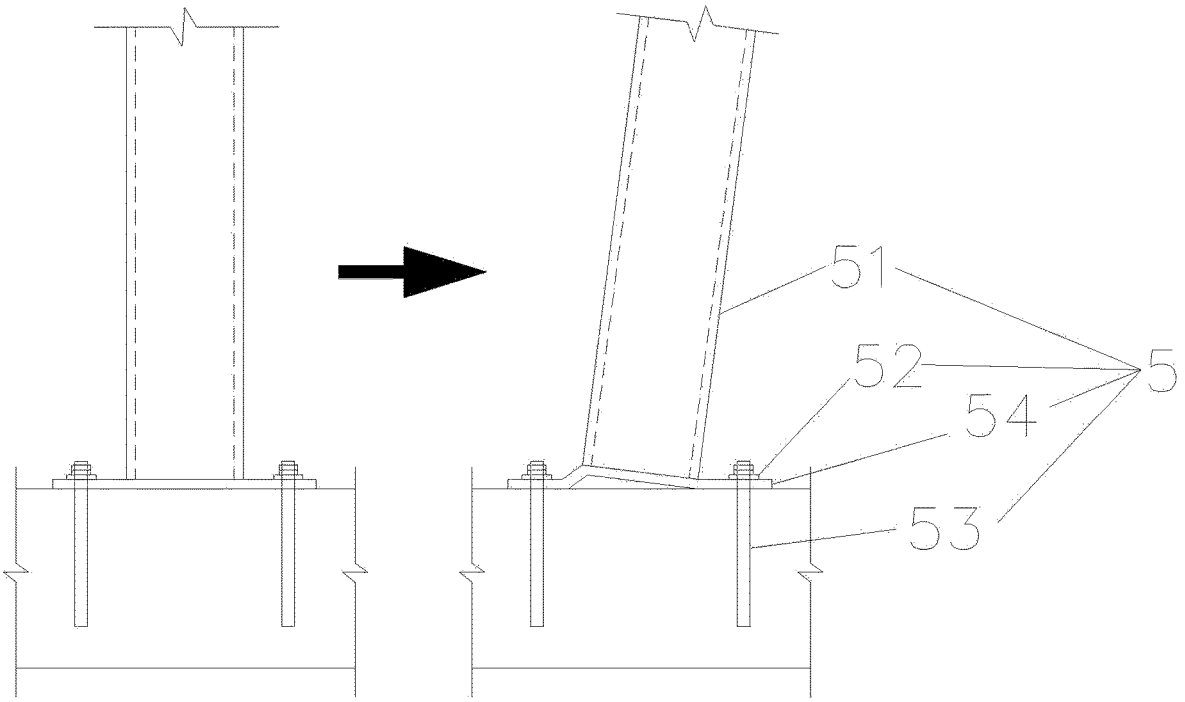
FIG. 10 is a deformation diagram of the pin-ended box column base.

Further description of specific embodiments of the present invention in detail will be made below in combination with specific embodiments and drawings, but implementation of the present invention are not limited thereto.

Example 1

Description is made in combination with FIGS. 3*a*, 3*b* and 4-9, and FIG. 13. A resilient prestress-free steel structure formed by combining pin-ended columns with an elastic centering beam includes an elastic centering beam 4 and two pin-ended box column bases 5. The elastic centering beam 4 includes two cantilever segment I-shaped steel beams 41, a middle segment I-shaped steel beam 42, two suspended connectors 43, four upper friction base plates 44, two buckling restrained energy dissipating plates 45 and four buckling restrained high strength steel bars 46. The middle segment I-shaped steel beam 42 is connected between the two cantilever segment I-shaped steel beams 41, the four buckling restrained high strength steel bars 46 are symmetrically arranged on two sides of a web along a beam central axis, to play a role of connecting the cantilever segment I-shaped steel beams 41 with the middle segment I-shaped steel beam 42, and the resilient prestress-free steel structures are arranged left and right symmetrically. Two ends of one of the buckling restrained high strength steel bars 46 are firmly connected with two connecting steel plates 471 through high strength nuts (as shown in the FIG. 13), the two connecting steel plates 471 are firmly connected with two force transfer steel plates 472 via butt welds, upper and lower edges of the connecting steel plates 471 are aligned with the upper edge of one force transfer steel plate 472 and the lower edge of the other force transfer steel plate 472 one by one, the two force transfer steel plates 472 at the left end are firmly connected with the webs of the cantilever segment I-shaped steel beams 41, and the two force transfer steel plates 472 at the right end are firmly connected with the web of the middle segment I-shaped steel beam 42 via fillet welds on two sides. The buckling restrained high strength steel bars 46 have the same structure.

The four upper friction base plates 44 are connected and fixed to lower portions of lower flanges of two ends of the two cantilever segment I-shaped steel beams 41 and the middle segment I-shaped steel beam 42 via weld joints respectively. The round screw holes correspond one by one, the lower surfaces of the upper friction base plates 44 are subjected to sand blasting treatment, and a friction coefficient of the upper friction base plates is not lower than 0.45. The two buckling restrained energy dissipating plates 45 are arranged on the lower portions of the I-shaped steel beams, and two ends of one of the two buckling restrained energy dissipating plates 45 are firmly connected with the two upper friction base plates 44 via several high strength bolts. Two ends of one suspended connector 43 are fixed to the cantilever segment I-shaped steel beams 41 and the middle segment I-shaped steel beam 42 respectively. The cantilever segment I-shaped steel beams 41 on two sides of the structure are rigidly connected with the two pin-ended box column bases 5 via weld joints. According to the resilient prestress-free steel structure formed by combining pin-ended columns with an elastic centering beam, the central axes of the cantilever segment I-shaped steel beams 41 are aligned with the central axis of the middle segment I-shaped steel beam 42.

Figure 15:
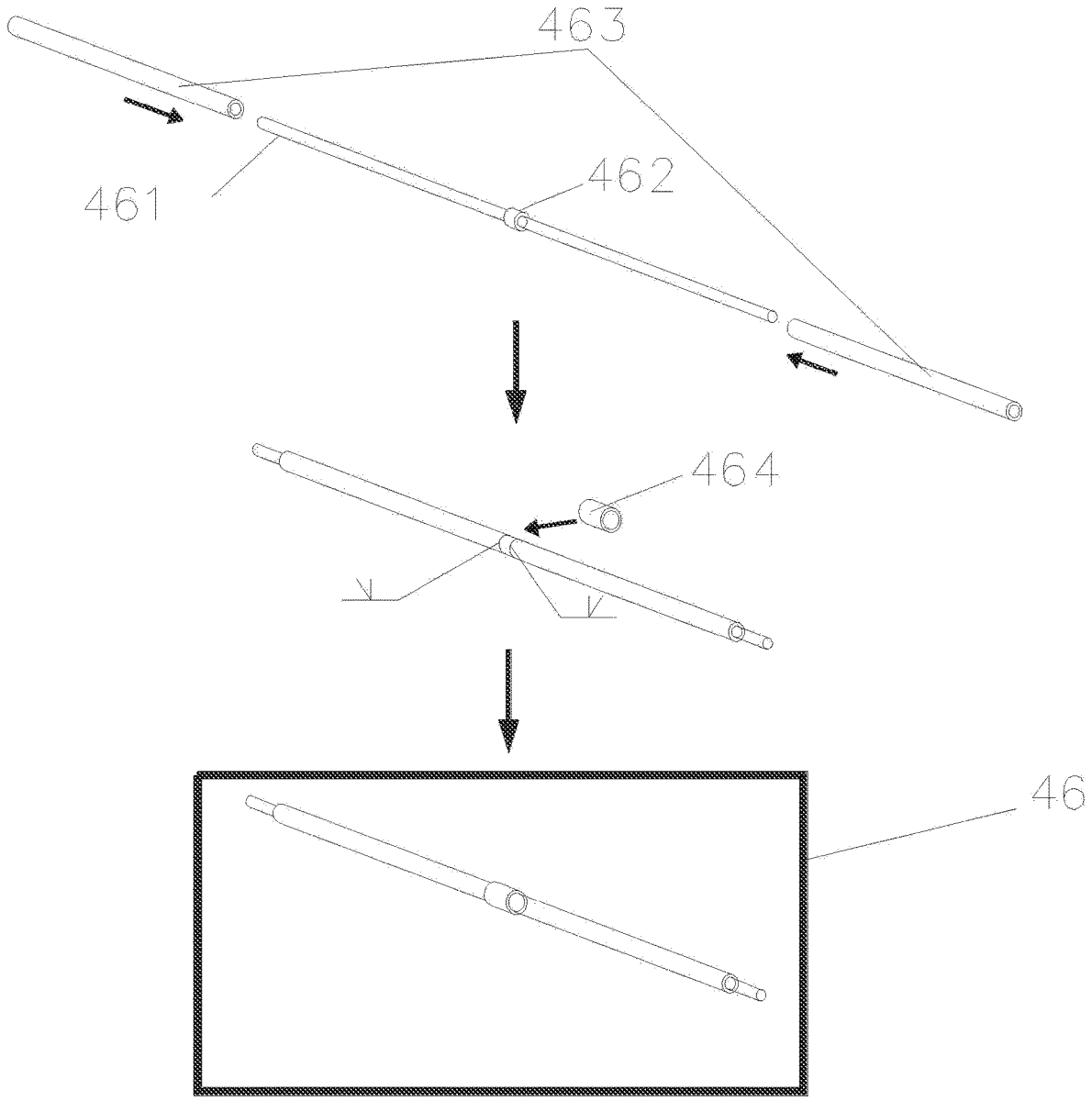
FIG. 15 is an assembling schematic diagram of the buckling restrained high strength steel bar in the present invention.

Description is made in combination with the FIG. 15, one buckling restrained high strength steel bar 46 of the embodiment is composed of one high strength bolt 461, one fixed cylindrical nut 462, two restraining steel tubes 463 and one middle segment restraining short steel tube 464. The fixed cylindrical nut 462 is fixed to a midpoint position of the high strength screw 461 through a thread, the restraining steel tubes 463 are symmetrically arranged on two sides of the fixed cylindrical nut 462 and are firmly connected with the fixed cylindrical nut 462 via butt welds, and inner diameters of the two restraining steel tubes 463 are greater than a diameter of the high strength screw 461, such that it is ensured that a 1-2 mm gap is reserved between the high strength screw 461 and each of the two restraining steel tubes 463. Two ends of the middle segment restraining short steel tube 464 are firmly connected with the two restraining steel tubes 463 via fillet welds respectively, and the midpoint position of the middle segment restraining short steel tube 464 is aligned with the midpoint position of the high strength screw 461. The four buckling restrained high strength steel bars 46 of an integral structure are arranged in such a way. Arranged in such a way, the structure is simple, and the problem of integral instability as the high strength bolts 461 is pressed can be solved effectively. Other embodiments are as same as above.

Figure 12:
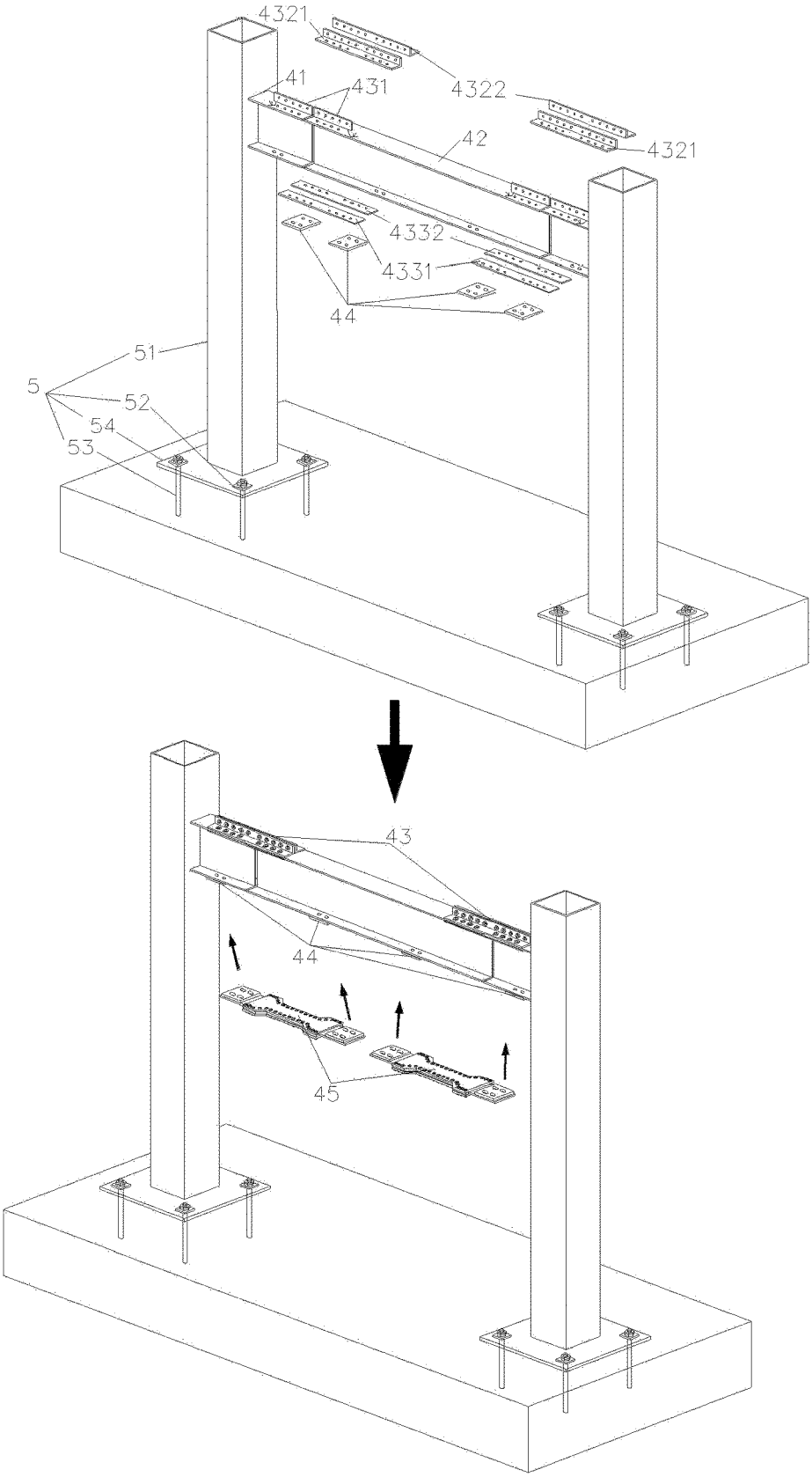
FIG. 12 is a schematic diagram of a third step and a fourth step of assembling the resilient prestress-free steel structure formed by combining pin-ended columns with the elastic centering beam of the present invention.
Figure 14:
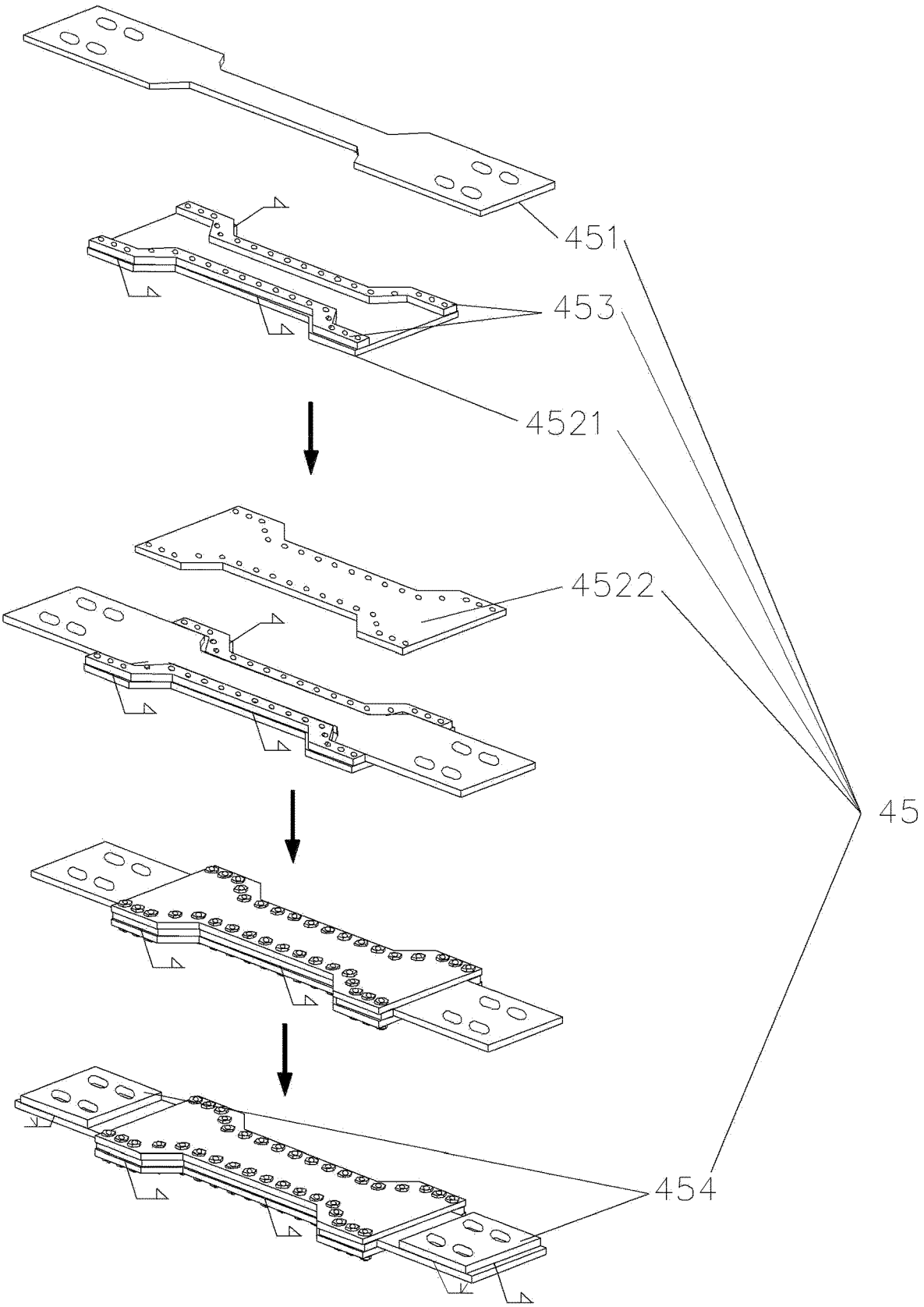
FIG. 14 is an assembling schematic diagram of the buckling restrained energy dissipating plate in the present invention.

Description is made in combination with the FIG. 12 and FIG. 14, the buckling restrained energy dissipation plate 45 is composed of a linear-shaped core plate 451, a first restraining steel plate 4521, a second restraining steel plate 4522, two limiting steel plates 453 and two lower friction base plates 424. The linear-shaped core plate 451 is dog bone-shaped, grooves matched with the limiting steel plates 453 in shape are processed in two side surfaces in a length direction of the linear-shaped core plate 451 respectively, the first restraining steel plate 4521 is firmly connected with the two limiting steel plates 453 via fillet welds, the limiting steel plates 453 are provided with several bolt holes, screw holes in the first restraining steel plate 4521 and the second restraining steel plate 4522 correspond to the screw holes in the two limiting steel plates 453 one by one. A linear-shaped core plate 451 is mounted between the two limiting steel plates 453 via a groove and are positioned between the first restraining steel plate 4521 and the second restraining steel plate 4522, the second restraining steel plate 4522 is firmly connected with the two limiting steel plates 453 and the first restraining steel plate 4521 via several high strength bolts and fixes the linear-shaped core plate 451. Unbounded materials are bonded to a left side surface, a right side surface, an upper side surface and a lower side surface of the linear-shaped core plate 451, the linear-shaped core plate 451 and the two limiting steel plates 453 are 2 mm different in thickness, such that it is ensured that gaps reserved between an upper surface and a lower surface of the linear-shaped core plate 451 and the first restraining steel plate 4521 and the second restraining steel plate 4522 are 1 mm respectively. The difference between the relative distance in the width direction of the two limiting steel plates 453 and the yield segment of the linear-shaped core plate 451 is 4 mm, such that it is ensured that gaps reserved between the left side surface and the right side surface of the linear-shaped core plate 451 and the limiting steel plates 453 are 2 mm. The two lower friction base plates 454 are firmly connected with two ends of the linear-shaped core plate 45 via fillet welds and butt welds, the upper surfaces of the two lower friction base plates 454 are subjected to sand blasting treatment, the friction coefficient thereof is not lower than 0.45, and the slotted screw holes of the two lower friction base plates 454 correspond to the slotted screw holes in two ends of the linear-shaped core plate 451 one by one. The two buckling restrained energy dissipating plates 45 of an integral structure are arranged in such a way. Arranged in such the way, it is reliable to connect. Other embodiments are as same as above.

The lower portions of the lower flanges of each of the cantilever segment I-shaped steel beams 41 and the middle segment I-shaped steel beam 42 are connected and fixed to the upper friction base plate 44 via weld joints, round screw holes of the lower flanges of each of the cantilever segment I-shaped steel beams 41 and the middle segment I-shaped steel beam 42 correspond to round screw holes of the upper friction base plate 44 one by one, the lower surface of the upper friction base plate 44 is subjected to sand blasting treatment, and a friction coefficient of the upper friction base plate is not lower than 0.45. The upper friction base plate 44 and the lower friction base plates 454 are made in contact, and the linear-shaped core plate 451, the lower friction base plates 454, the upper friction base plate 44 and the lower flange of each of the cantilever segment I-shaped steel beams 41 or the middle segment I-shaped steel beam 42 are arranged in sequence from bottom to top and are connected via bolts.

Description is made in combination with the FIGS. 3*a*, 3*b* and 4-9, and FIG. 12. One end of the suspended connector 43 is fixed to an upper flange of each of the cantilever segment I-shaped steel beams 41 and the other end of the suspended connector is fixed to an upper flange of the middle segment I-shaped steel beam 42. The suspended connector 43 includes two vertical anti-shearing plates 431, first splicing angle iron 4321, second splicing angle iron 4322, a first splicing steel plate 4331 and a second splicing steel plate 4332. The first splicing angle iron 4321, the second splicing angle iron 4322, the first splicing steel plate 4331 and the second splicing steel plate 4332 are equal in length, and the length is equal to two times of the length of the vertical anti-shearing plates 431 with the addition of a gap between the middle segment I-shaped steel beam 42 and each of the cantilever segment I-shaped steel beams 41 along an axis direction. The two vertical anti-shearing plates 431 are firmly connected with the cantilever segment I-shaped steel beams 41 and the middle segment I-shaped steel beam 42 via the butt welds respectively, a shorter side plate of the first splicing angle iron 4321 and a shorter side plate of the second splicing angle iron 4322 are firmly connected with the two vertical anti-shearing plate 431 via high strength bolts. The round screw holes in the shorter side plates of the first splicing angle iron 4321 and the second splicing angle iron 4322 correspond to the round screw holes in the two vertical anti-shearing plates 431 one by one and are fixed via the high strength bolts, and the shorter side plate of the first splicing angle iron 4321 and the shorter side plate of the second splicing angle iron 4322 are symmetrically arranged on two sides of the vertical anti-shearing plates 431.

The first splicing steel plate 4331 is firmly connected with the upper flange of each of the cantilever segment I-shaped steel beam 41, the upper flange of the middle segment I-shaped steel beam 42 and the longer side plate of the first splicing angle iron 4321 via the high strength bolts respectively. The upper flange of the I-shaped steel beam is located between the first splicing steel plate 4331 and the longer side plate of the first splicing angle iron 4321. The second splicing steel plate 4332 is firmly connected with the upper flange of each of the cantilever segment I-shaped steel beam 41, the upper flange of the middle segment I-shaped steel beam 42 and the longer side plate of the second splicing angle iron 4322 the high strength bolts respectively. The upper flange of the I-shaped steel beam is located between the second splicing steel plate 4332 and the longer side plate of the second splicing steel plate 4332. The two suspended connectors 43 of an integral structure are arranged in such a way. Arranged in such the way, the structure is simple and easy to mount and the using function of a building is not limited. Other embodiments are as same as above.

Description is made in combination with the FIG. 9 to FIG. 12, one pin-ended box column base 5 of the embodiment is composed of a box type column 51, four base plates 52, four anchor bolts 53 and a bottom plate 54. The box type column 51 is firmly connected with the bottom plate 54 via the fillet weld, the bottom plate 54 is firmly connected with foundation soil via the four anchor bolts 53 and the four base plates 52 play a role of expanding the stress area, such that it is more uniform to stress. The two pin-ended box column bases are arranged in such the way. Arranged in such the way, the structure is simple, it is ensured that the column base does not transfer the bending moment, the bottom plate 54 cannot restrain deformation of the box type column 51 and a role of the articulated column base is played. The box type column 51 is connected with the cantilever segment I-shaped steel beam 41 via the weld joint.

Figure 11:
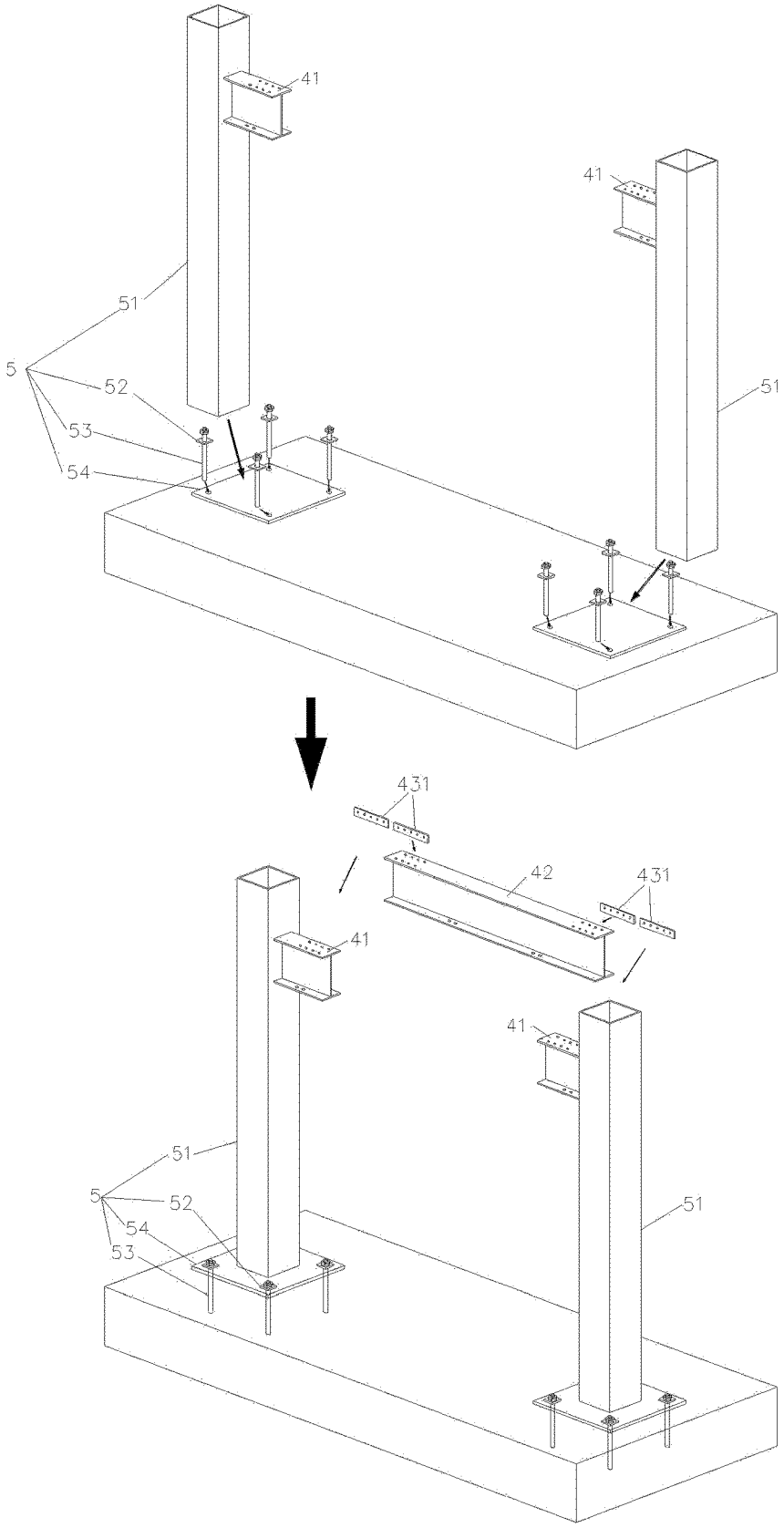
FIG. 11 is a schematic diagram of a first step and a second step of assembling the resilient prestress-free steel structure formed by combining pin-ended columns with the elastic centering beam of the present invention.
Figure 13:
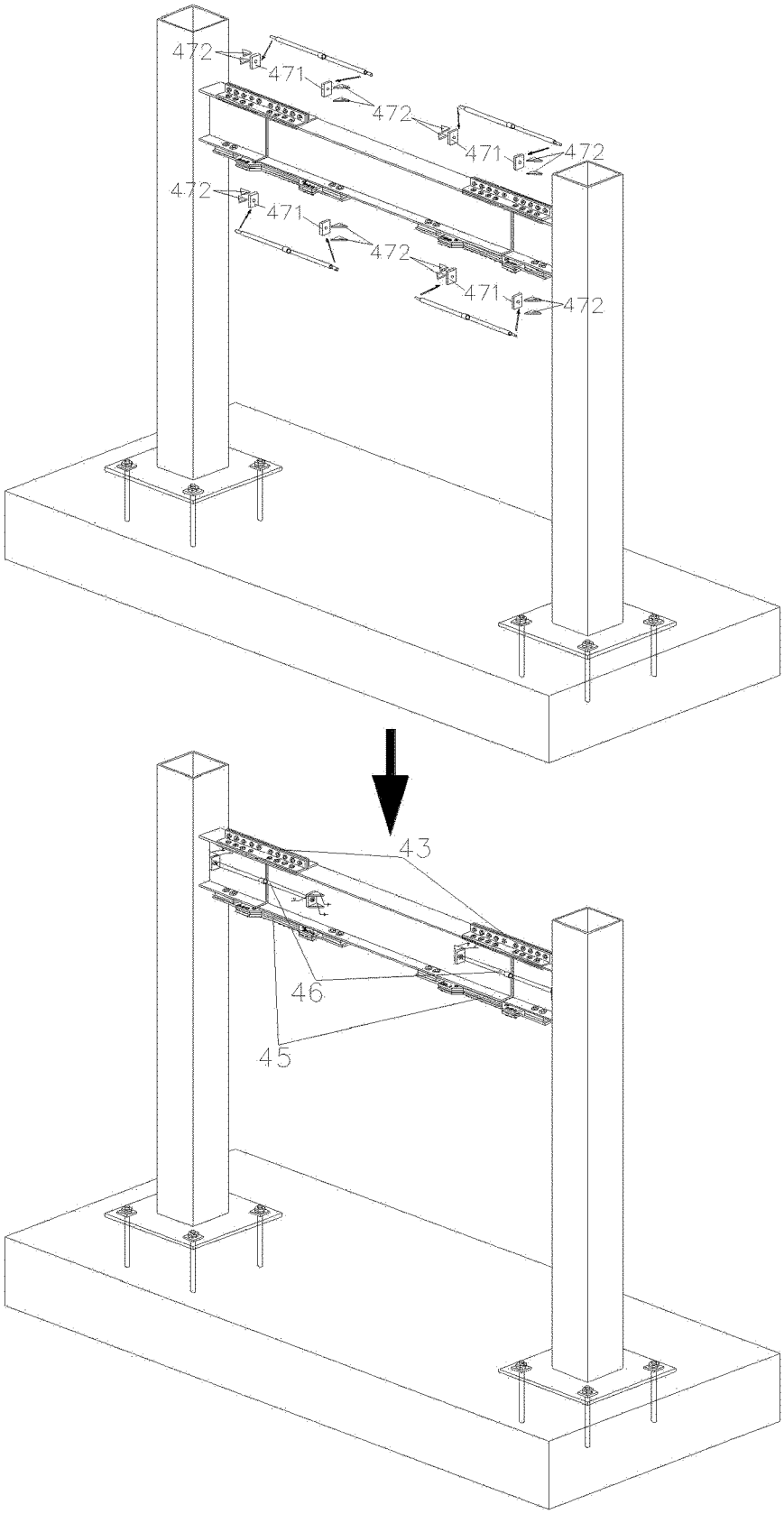
FIG. 13 is a schematic diagram of a fifth step and a sixth step of assembling the resilient prestress-free steel structure formed by combining pin-ended columns with the elastic centering beam of the present invention.

As shown in the FIG. 11 to FIG. 13, a method for processing the resilient prestress-free steel structure formed by combining pin-ended columns with an elastic centering beam of the present invention includes the following steps. Step 1, the two box type columns 51 are rigidly connected with the two cantilever segment I-shaped steel beams 41 via the weld joints, the two box type columns 51 are firmly connected with the two bottom plates 54 via fillet welds, and the two bottom plates 54 are then firmly connected with a foundation via the anchor bolts 53 and the base plates 52. Step 2, two ends of the middle segment I-shaped steel beam 42 are connected with the two cantilever segment I-shaped steel beams 41 via the two suspended connectors 43 respectively. Step 3, mounting positions of the four upper friction base plates 44 are determined according to a principle of corresponding bolt holes one by one, and are firmly connected with the lower flanges of the two cantilever segment I-shaped steel beams 41 and the lower flange of the middle segment I-shaped steel beam 42 via the butt welds and the fillet welds, the two buckling restrained energy dissipating plates 45 are then firmly connected with the lower flanges of the two cantilever segment I-shaped steel beams 41 and the middle segment I-shaped steel beam 42 via the high strength bolts after main vertical loads are applied to the beam (for example, a cast-in-place concrete floorslab, a partition wall and the like). The slotted bolt holes of the lower friction base plates 454 on the buckling restrained energy dissipating plates 45 correspond to the round bolt holes in the upper friction base plates 44. Step 4, the two force transfer steel plates 472 are firmly connected with the connecting steel plate 471 via the butt welds and are firmly connected with the webs of the cantilever segment I-shaped steel beams 41 via the fillet welds, and it is ensured that the central axis of the beam-end is superposed with a central axis of a long edge of the connecting steel plate 471, the two high strength nuts are symmetrically arranged on two sides of the connecting steel plate 471 after one buckling restrained high strength steel bar 46 is firmly connected with one connecting steel plate 471 via two high strength nuts, one connecting steel plate 471, two force transfer steel plates 472 and the middle segment I-shaped steel beam 42 are spliced and fixed one another at the other end according to a corresponding flow, and firmed connection at the other end of the buckling restrained high strength steel bar 46 is finished via the high strength bolts. The firmed connection flows of the other three buckling restrained high strength steel bars 46 are carried out in a similar way.

The above is merely preferred embodiments of the present invention and is not limitation to the present invention in any form. Any equivalent changes, modifications or deviations made to the embodiments by those skilled in the art according to the technical scheme shall fall within the scope of the technical scheme of the present invention.

What is claimed is:

1. A resilient prestress-free steel structure, comprising an elastic centering beam and two pin-ended box column bases, wherein the elastic centering beam comprises two cantilever segment I-shaped steel beams, a middle segment I-shaped steel beam and buckling restrained high strength steel bars, the cantilever segment I-shaped steel beams are fixed to the two pin-ended box column bases, the middle segment I-shaped steel beam is connected between the two cantilever segment I-shaped steel beams, the buckling restrained high strength steel bars are symmetrically arranged on two sides of a web of the elastic centering beam along a beam central axis, and one end of each of the buckling restrained high strength steel bars is firmly connected with a web of each of the cantilever segment I-shaped steel beams, and the other end of each of the buckling restrained high strength steel bars is firmly connected with a web of the middle segment I-shaped steel beam; and the resilient prestress-free steel structure is arranged left and right symmetrically, wherein each of the buckling restrained high strength steel bars comprises a high strength screw, a fixed cylindrical nut, two restraining steel tubes and a middle segment restraining short steel tube; the fixed cylindrical nut is fixed to a midpoint position of the high strength screw through a thread, the restraining steel tubes are symmetrically arranged on two sides of the fixed cylindrical nut and are firmly connected with the fixed cylindrical nut via butt welds, and inner diameters of the two restraining steel tubes are greater than a diameter of the high strength screw, such that a gap is reserved between the high strength screw and each of the two restraining steel tubes; the middle segment restraining short steel tube penetrates through the fixed cylindrical nut, two ends of the middle segment restraining short steel tube are firmly connected with the two restraining steel tubes via fillet welds respectively, and a midpoint position of the middle segment restraining short steel tube is aligned with the midpoint position of the high strength screw.

2. The resilient prestress-free steel structure according to claim 1, wherein two ends of each of the buckling restrained high strength steel bars are firmly connected with a connecting steel plate through high strength nuts on two sides, the connecting steel plate is firmly connected with two force transfer steel plates via butt welds, upper and lower edges of the connecting steel plate are aligned with an upper edge of one force transfer steel plate and a lower edge of the other force transfer steel plate one by one, the force transfer steel plate on a side of each of the cantilever segment I-shaped steel beams is firmly connected with the web of each of the cantilever segment I-shaped steel beams, and the force transfer steel plate on a side of the middle segment I-shaped steel beam is firmly connected with the web of the middle segment I-shaped steel beam via fillet welds on two sides.

3. The resilient prestress-free steel structure according to claim 1, further comprising a suspended connector, wherein one end of the suspended connector is fixed to an upper flange of each of the cantilever segment I-shaped steel beams and the other end of the suspended connector is fixed to an upper flange of the middle segment I-shaped steel beam; the suspended connector comprises two vertical anti-shearing plates, first splicing angle iron, second splicing angle iron, a first splicing steel plate and a second splicing steel plate; the first splicing angle iron, the second splicing angle iron, the first splicing steel plate and the second splicing steel plate are equal in length, and the length is equal to two times of a length of the vertical anti-shearing plates with an addition of a gap between the middle segment I-shaped steel beam and each of the cantilever segment I-shaped steel beams along an axis direction; one of the vertical anti-shearing plates is firmly connected with the upper surface of the upper flange of each of the cantilever segment I-shaped steel beams via the butt weld, and the other vertical anti-shearing plates is firmly connected with the upper surface of the upper flange of the middle segment I-shaped steel beam via the butt weld, a shorter side plate of the first splicing angle iron and a shorter side plate of the second splicing angle iron are firmly connected with the vertical anti-shearing plate via high strength bolts, and the shorter side plate of the first splicing angle iron and the shorter side plate of the second splicing steel plate are symmetrically arranged on two sides of the vertical anti-shearing plate; the first splicing steel plates are firmly connected with the upper flange of each of the cantilever segment I-shaped steel beams and the upper flange of the middle segment I-shaped steel beam as well as a longer side plate of the first splicing angle iron via high strength bolts respectively, and the upper flange of the I-shaped steel beam is located between the first splicing steel plate and the longer side plate of the first splicing angle iron; the second splicing angle iron is firmly connected with the upper flange of each of the cantilever segment I-shaped steel beams and the upper flange of the middle segment I-shaped steel beam as well as a longer side plate of the second splicing angle iron respectively, and the upper flange of the I-shaped steel beam is located between the second splicing steel plate and the longer side plate of the second splicing steel plate.

4. The resilient prestress-free steel structure according to claim 1, wherein each of the two pin-ended box column bases comprises a box-shaped column, a base plate, an anchor bolt and a bottom plate, wherein the box-shaped column is firmly connected with the bottom plate via a fillet weld, and the anchor bolt penetrates through the base plate to firmly connect a periphery of the bottom plate with foundation soil; and the box-shaped column is connected with each of the cantilever segment I-shaped steel beams via a weld joint.

5. The resilient prestress-free steel structure according to claim 1, wherein the high strength screw is manufactured by a 14.9-level high strength bolt.

6. The resilient prestress-free steel structure according to claim 1, further comprising a buckling restrained energy dissipation plate, wherein one end of the buckling restrained energy dissipation plate is fixed to a lower portion of a lower flange of each of the cantilever segment I-shaped steel beams and the other end of the buckling restrained energy dissipation plate is fixed to a lower portion of the lower flange of the middle segment I-shaped steel beam; the buckling restrained energy dissipation plate includes a linear-shaped core plate, a first restraining steel plate, a second restraining steel plate and two limiting steel plates; the linear-shaped core plate is dog bone-shaped, grooves matched with the limiting steel plates in shape are processed in two side surfaces in a length direction of the linear-shaped core plate respectively, slotted holes are formed in connecting segments at two ends of the length direction of the linear-shaped core plate, the limiting steel plates are positioned between the first restraining steel plate and the second restraining steel plate, the limiting steel plates are positioned on two sides of the linear-shaped core plate, the limiting steel plates are matched with the linear-shaped core plate in structure, the limiting steel plates are provided with several bolt holes, and positions of the first restraining steel plate and the second restraining steel plate corresponding to the limiting steel plates are provided with bolt holes; the linear-shaped core plate is fixed via a bolt, the first restraining steel plate is firmly connected with the two limiting steel plates via fillet welds, wherein unbounded materials are bonded to a left side surface, a right side surface, an upper side surface and a lower side surface of the linear-shaped core plate, the linear-shaped core plate and the two limiting steel plates are different in thickness, such that gaps are reserved between an upper surface and a lower surface of the linear-shaped core plate and the first restraining steel plate and the second restraining steel plate respectively; gaps are reserved between the limiting steel plates and a yield segment of the linear-shaped core plate, such that gaps are reserved between the left side surface and the right side surface of the linear-shaped core plate and the limiting steel plates.

7. The resilient prestress-free steel structure according to claim 6, wherein the buckling restrained energy dissipation plate further comprises two lower friction base plates, wherein the lower friction base plates are firmly connected with two ends of the linear-shaped core plate via fillet welds and butt welds, upper surfaces of the lower friction base plates are subjected to sand blasting treatment, a friction coefficient of the lower friction base plates is not lower than 0.45, and slotted screw holes in the two lower friction base plates correspond to slotted screw holes in two ends of the linear-shaped core plate one by one; the lower portions of the lower flanges of each of the buckling restrained high strength steel bars and the middle segment I-shaped steel beam are connected and fixed to an upper friction base plate via weld joints, round screw holes of the lower flanges of each of the buckling restrained high strength steel bars and the middle segment I-shaped steel beam correspond to round screw holes of the upper friction base plate one by one, the lower surface of the upper friction base plate is subjected to sand blasting treatment, and a friction coefficient of the upper friction base plate is not lower than 0.45; the upper friction base plate and the lower friction base plates are made in contact, and the linear-shaped core plate, the lower friction base plates, the upper friction base plate and the lower flange of each of the buckling restrained high strength steel bars or the middle segment I-shaped steel beam are arranged in sequence from bottom to top and are connected via bolts.

* * * * *